United States Patent [19]

Montgomery et al.

[11] Patent Number: 4,954,010

[45] Date of Patent: Sep. 4, 1990

[54] TRANSVERSE-MOUNTED SLURRY SEALANT BOX ASSEMBLY

[76] Inventors: Darryl R. Montgomery, 3109 Amity Rd., Hilliard, Ohio; David C. Raber, 10999 Converse Rd., Plain City, Ohio 43064

[21] Appl. No.: 484,163

[22] Filed: Feb. 21, 1990

[51] Int. Cl.[5] ..... E01C 19/22; E04G 21/10

[52] U.S. Cl. ..... 404/96; 404/101

[58] Field of Search ..... 404/96, 102, 107, 113, 404/118, 72, 73, 101; 425/456

[56] References Cited

U.S. PATENT DOCUMENTS

| | | | |
|---|---|---|---|
| 3,865,501 | 2/1975 | Kniep | 404/72 |
| 3,936,211 | 2/1976 | Miller et al. | 404/96 |
| 4,066,374 | 1/1978 | King | 404/117 |
| 4,074,802 | 2/1978 | Hudis | 404/101 |
| 4,411,554 | 10/1983 | Gratzfeld | 404/101 |
| 4,555,200 | 11/1985 | Morrison | 404/72 |
| 4,583,879 | 4/1986 | Hofman | 404/73 |
| 4,775,313 | 11/1988 | DiIoia | 404/118 |
| 4,830,533 | 5/1989 | Miller | 404/101 |
| 4,854,769 | 8/1989 | Fukukawa et al. | 404/72 |

*Primary Examiner*—Bruce M. Kisliuk
*Assistant Examiner*—Gay Ann Spahn
*Attorney, Agent, or Firm*—Mueller and Smith

[57] ABSTRACT

The present invention is addressed to the foregoing described need in the art for a mechanized means for filling transverse cracks in roadways. Broadly, the sealant box assembly of the present invention is connectable to a vehicle and adapted to fill transverse roadway cracks wherein the roadway has a center line. Such assembly comprises a sealant box adapted to receive and dispense fluent material onto a roadway; a boom assembly which carries the sealant box and has a drive for moving said sealant box along its length. One end of the boom assembly is positioned for the sealant box to be located at the center line of the roadway while the vehicle is spaced apart therefrom. A chute extends from the vehicle to the sealant box for filling the sealant box with fluent material. Finally, a mounting assembly is connectable to the vehicle and is pivotally connected to the boom assembly for its vertical movement. Advantageously, the mounting assembly is pivotally connected to the boom assembly for both vertical and rotational movement thereof.

22 Claims, 4 Drawing Sheets

TRANSVERSE-MOUNTED SLURRY SEALANT BOX ASSEMBLY

BACKGROUND OF THE INVENTION

The present invention relates to the filling of cracks in roadways using a slurry sealant box assembly and more particularly to the filling of roadway cracks that develop transverse to the direction of the roadway utilizing a transverse-mounted rut box assembly.

A variety of techniques have been developed to resurface, repair, or otherwise apply bituminous material to roadways. These techniques range from a laborer using a shovel to fill potholes to sophisticated machinery adapted to apply bituminous material to entire lanes of the roadway. A mechanical assembly that has been used to apply fluent bituminous paving material on half-lanes and whole lanes is commonly referred to as a "slurry sealant box". A slurry sealant box is an open-topped rectangular box sometimes containing a rotating auger disposed along its lengthwise extent and adapted to receive fluent bituminous paving material through the open top. A dispensing slot is formed at the bottom of the sealant box with side adjustable guides lifting the rear wall of the sealant box in order to control the thickness of the fluent material dispensed from the sealant box as it is pulled along the roadway by a truck or other vehicle. The direction of movement of the sealant box is transverse to its longitudinal extent. If the sealant box is nominally 4–6 feet in width, it is adapted to apply fluent bituminous paving material to one-half a lane, while 8 feet versions are adapted to cover an entire lane of the roadway. A suitable fluent bituminous paving material used in sealant boxes is Micro-Surfine.

Often, however, there is a need to fill a crack or other imperfection that develops transversely to the direction of traffic and the roadway. Such crack may occur by virtue of road work repair that has been undertaken, expansion and contraction stresses could cause a crack, adjacent slabs of concrete could move vertically relative to each other, or other cause may result in such transverse crack developing. Today, such transverse cracks are filled by hand, typically involving several laborers that shovel material about the crack in order to fill it. The use of laborers to repair such cracks creates expense and limits the number of cracks that can be filled in a normal workday. There is a need, then, to mechanize such transverse crack filling operation.

BROAD STATEMENT OF THE INVENTION

The present invention is addressed to the foregoing described need in the art for a mechanized means for filling transverse cracks in roadways. Broadly, the sealant box assembly of the present invention is connectable to a vehicle and adapted to fill transverse roadway cracks wherein the roadway has a center line. Such assembly comprises a sealant box adapted to receive and dispense fluent material onto a roadway; a boom assembly which carries the sealant box and has a drive for moving said sealant box along its length. One end of the boom assembly is positioned for the sealant box to be located at the center line of the roadway while the vehicle is spaced apart therefrom. A chute extends from the vehicle to the sealant box for filling the sealant box wth fluent material. Finally, a mounting assembly is connectable to the vehicle and is pivotally connected to the boom assembly for its vertical movement. Advantageously, the mounting assembly is pivotally connected to the boom assembly for both vertical and rotational movement thereof.

Another aspect of the present invention is a method for filling transverse roadway cracks located in a roadway having a center line. Such method comprises:

filling with fluent material a sealant box which is adapted to receive and dispense fluent material onto a roadway, said sealant box being carried by a boom assembly which has a drive for moving the sealant box along its length. If not already there, the sealant box is positioned at the center line of the roadway with said boom assembly while the vehicle is spaced-apart from said center line. The drive is activated for moving the sealant box along the length of the boom assembly while the sealant box dispenses the fluent material onto the roadway to fill the transverse crack. Thereafter, a mounting assembly, which is pivotally connected to the vehicle and to the boom assembly, is activated to lift the sealant box from the roadway surface. The vehicle then can be driven to the next crack and the operation readily repeated for filling subsequent cracks. In an advantageous embodiment, the mounting assembly is pivotally connected to the boom assembly for its lateral movement so that the sealant box can be positioned over cracks that do not align precisely transverse to the vehicle as it is positioned adjacent to the crack in the roadway.

Advantages of the present invention include the ability to efficiently and rapidly fill transverse cracks in roadways. Another advantage is the ability to readily transport the inventive assembly to remote locations for its use. A further advantage is the ability to not be restricted to precisely locating the vehicle carrying the inventive sealant box assembly adjacent to the crack for its filling. A yet further advantage is the ability to locate the vehicle away from the center line of the highway for safety. Yet another advantage for safety is the ability to always drive the vehicle in the direction of traffice in the lane containing the transverse cracks. These and other advantages will be readily apparent to those skilled in the art based upon the disclosure contained herein.

Figure 1:
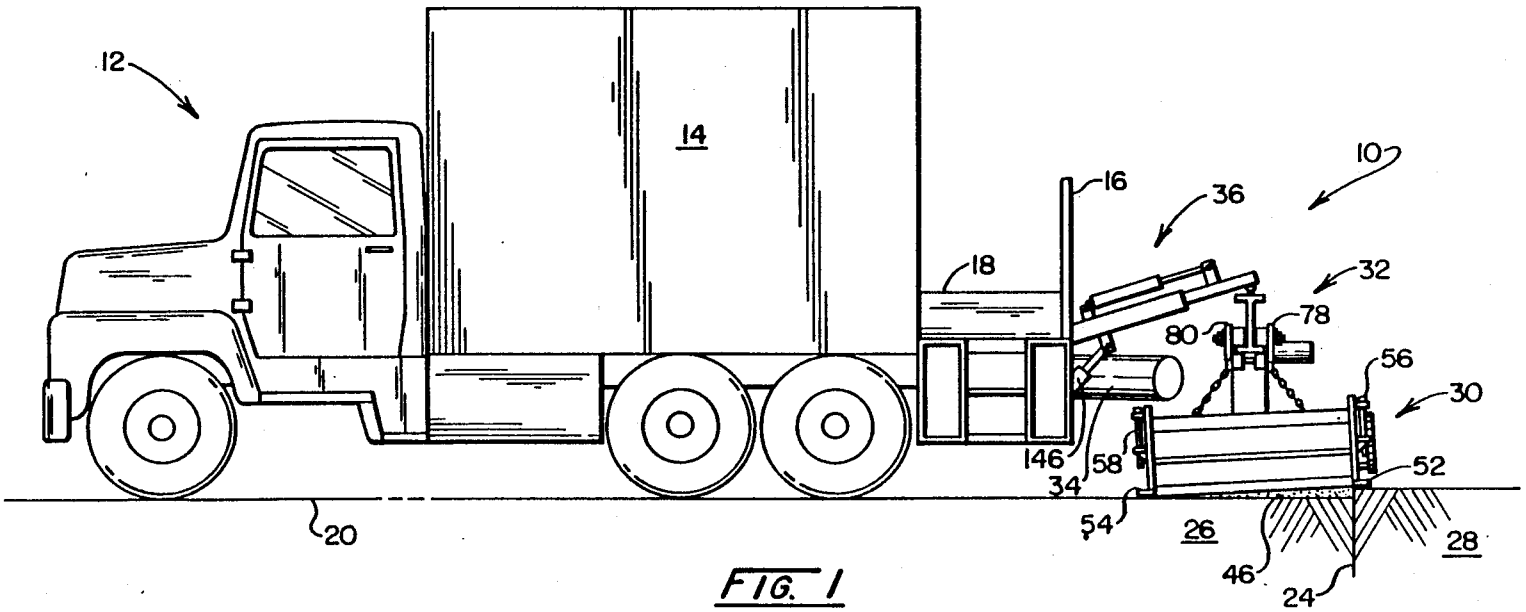
FIG. 1 is a side elevational view of the inventive sealant box assembly attached to the rear of a vehicle wherein the sealant box assembly is positioned for filling a crack in a roadway.

The drawings will be described in detail below.

DETAILED DESCRIPTION OF THE INVENTION

The sealant box assembly of the present invention, generally shown at 10, is seen mounted to truck 12 which retains fluent material tank 14 mounted at the rear thereof in conventional fashion. Tank 14 is stirred, typically with appropriate controls, feeders, etc. provided in accordance with needs and industrial practice. In this regard, controls (not shown in the drawings) for operation of inventive transverse sealant box assembly 10 preferably are disposed at or near railing 16 so that the operator can stand on platform 18 to operate the inventive assembly. It is conceivable, however, that remote operation of inventive sealant box assembly 10 from the ground may be desirable on occasion and such modification can be implemented by the skilled artisan.

Vehicle 12 is seen parked on roadway 20 which has a center line indicated by stripes 22. Inventive sealant box assembly 10 is seen in operable position for filling crack 24 which has developed due to the unevenness of the surfaces of roadway slabs 26 and 28. Such unevenness could result from the settling of slab 26 relative to 28 due to weather conditions or the like. Regardless of the cause for crack 24, it is desirable to fill the crack and a portion of the surface of slab 26 apart from crack 24 to provide a smooth transition from slab 28 to slab 26 as traffic proceeds thereover. With respect to vehicle 12, two important observations should be made. First, vehicle 12 is parked in the direction of traffic that proceeds over roadway 20. Safety considerations dictate the movement of vehicle 12 in the direction of traffic in the lane in which it is being driven. The second observation is that vehicle 12 is spaced apart from the center line of roadway 20 as indicated by stripe 22. Again, this lateral offset is dictated by safety considerations.

Inventive sealant box assembly 10 is comprised of four major components: sealant box 30, boom assembly 32, chute 34, and mounting assembly 36. Referring initially to sealant box 30, it will be observed from FIG. 3 that sidewalls 38 and 40, front wall 42, and rear wall 44 form the basic structure thereof. A fluent material outlet or slot comprises the bottom of sealant box 30 for dispensing fluent material 46 (see FIG. 1) therefrom. The top of sealant box 30 is open and adapted to receive fluent material 46. Housed within sealant box 30 is auger 48 which is powered from motor 50 via sprockets 53 and 54 which are interconnected via drive chain 56 (see FIG. 2). Auger 48 serves to distribute fluent material 46 evenly throughout the interior volume of sealant box 30 for its dispensing and provides mixing of fluent material 46 also. Sealant box 30 employs skids 52 and 54 which ride along slabs 26 and 28, skid 52 being placed adjacent crack 24. The vertical spacing of rear wall 44 from the surface of roadway 20 is adjusted via mechanisms 56 and 58 which raise and lower rear wall 44 relative to skids 52 and 54. The construction of sealant box 30 is fairly conventional as is its ability to spread fluent material 46 on the surface of roadway 20. While the lengthwise extent of sealant box 30 can be adjusted, it presently is contemplated that a 4 feet span for spreading fluent material 46 between crack 24 and line 60 (see FIG. 3) should be sufficient for providing a smooth transition between slabs 26 and 28. It will be observed that the distance between crack 24 and line 60 essentially is the distance between the interior edge of skids 52 and 54.

Sealant box 30 is carried by boom assembly 32. Boom assembly 32 broadly is comprised of center boom section 62, boom extension 64, and carriage assembly 66. Center boom section 62 is centrally disposed behind truck 12 while boom extension 64 projects laterally away from truck 12 a distance presently contemplated to range from about 8 to 12 feet. Boom sections 62 and 64 are attached via end plates 68 and 70 which are bolted together with bolts 72*a–d* (see FIG. 3). Triangular stiffeners 74 and 76 ensure that boom extension 64 can bear the weight of carriage assembly 66 and sealant box 30. It will be appreciated that center boom section 62 could be fitted with an end plate and stiffener assembly at its opposite end so that boom extension 64 could be affixed to either end thereof. Such a modification to center boom section 62 would permit carriage assembly 66 and sealant box 30 to be mounted for movement in either direction transverse to roadway 20 and to either side of truck 12 as it is parked. Such a modification would permit the filling of cracks that extended to either side of the vehicle 12 as it is parked on roadway 20, thus contributing to the flexibility and usefulness of inventive sealant box assembly 10.

Figure 2:
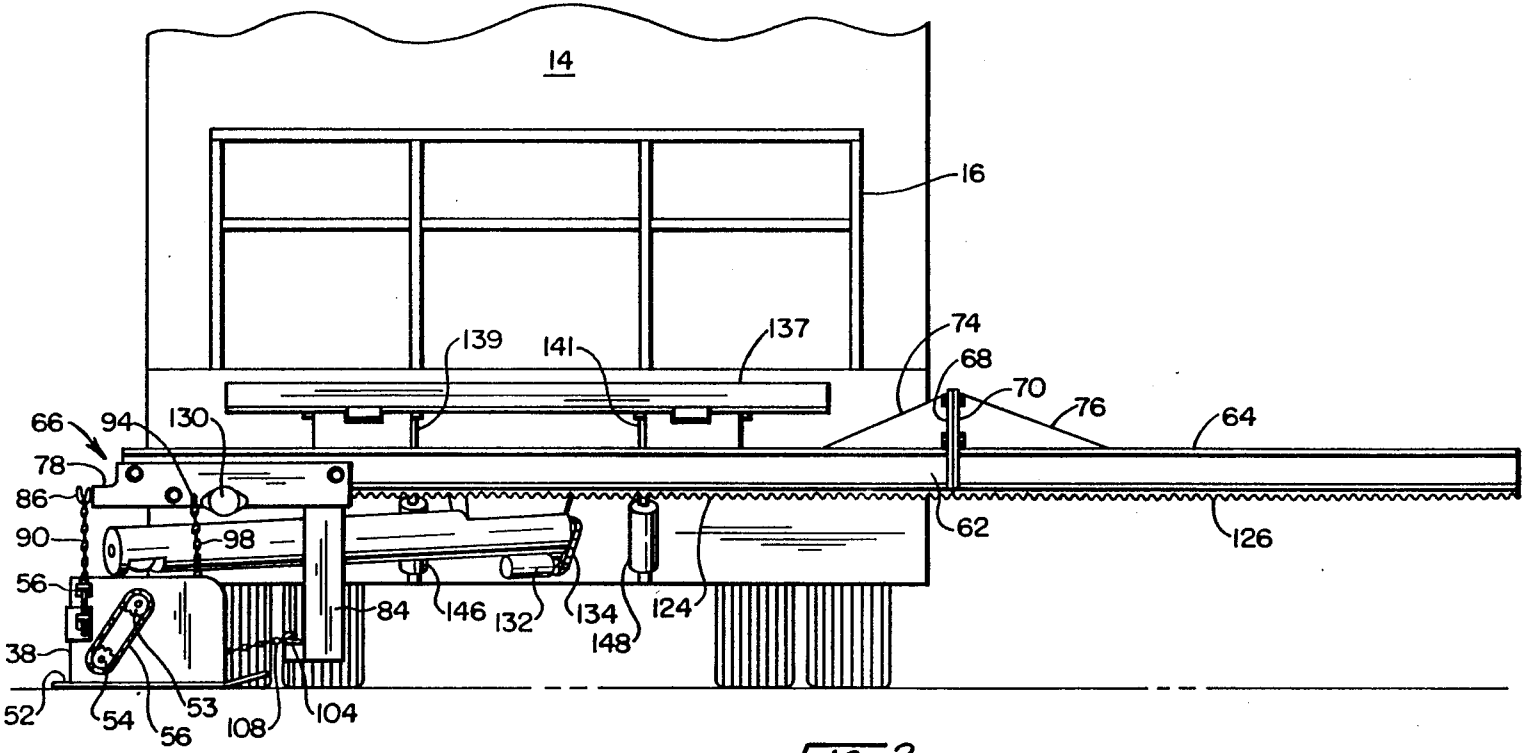
FIG. 2 is a rear view of the sealant box assembly and vehicle depicted in FIG. 1.
Figure 3:
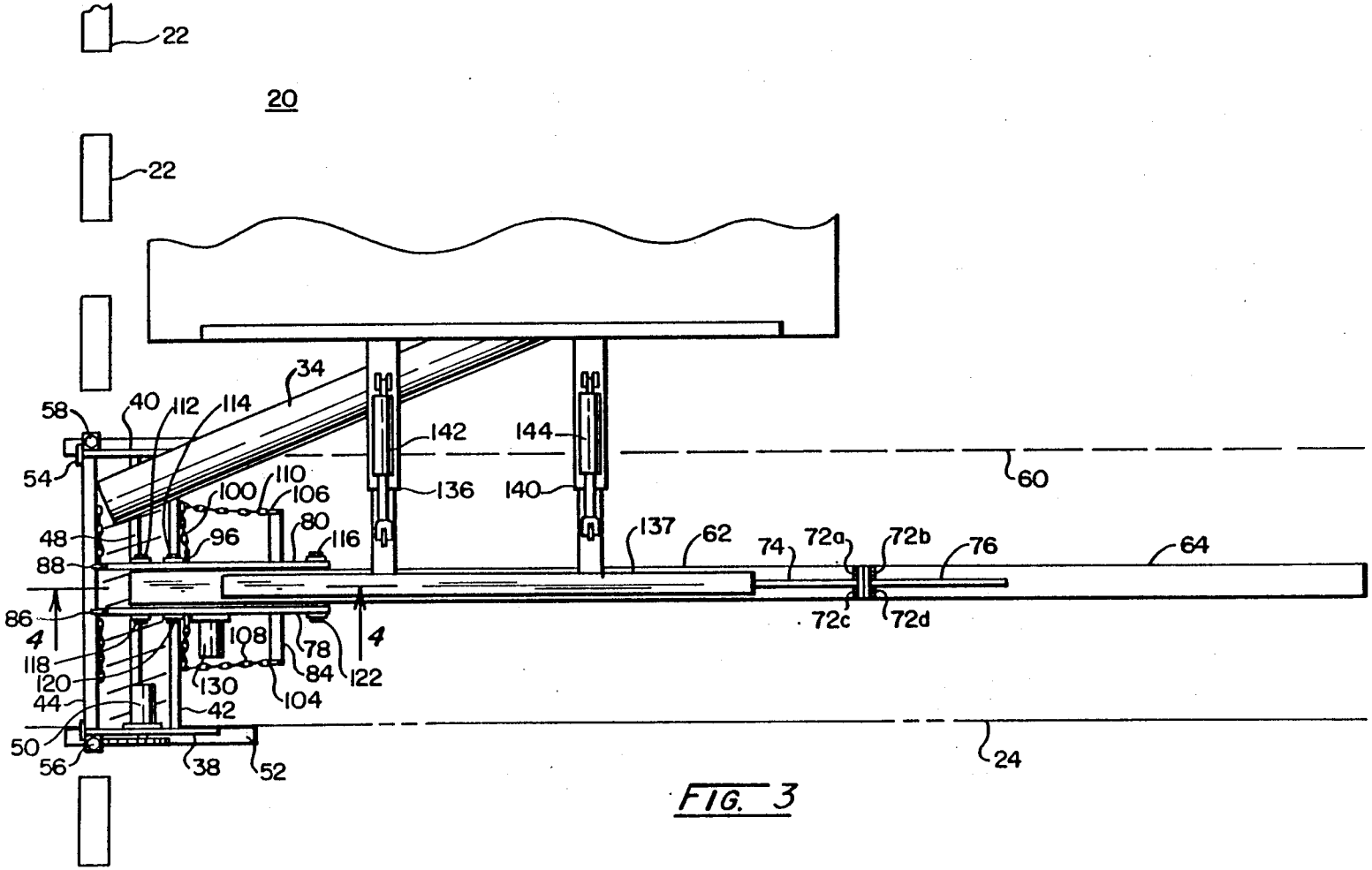
FIG. 3 is an overhead view of the sealant box assembly depicted in FIG. 1.
Figure 4:
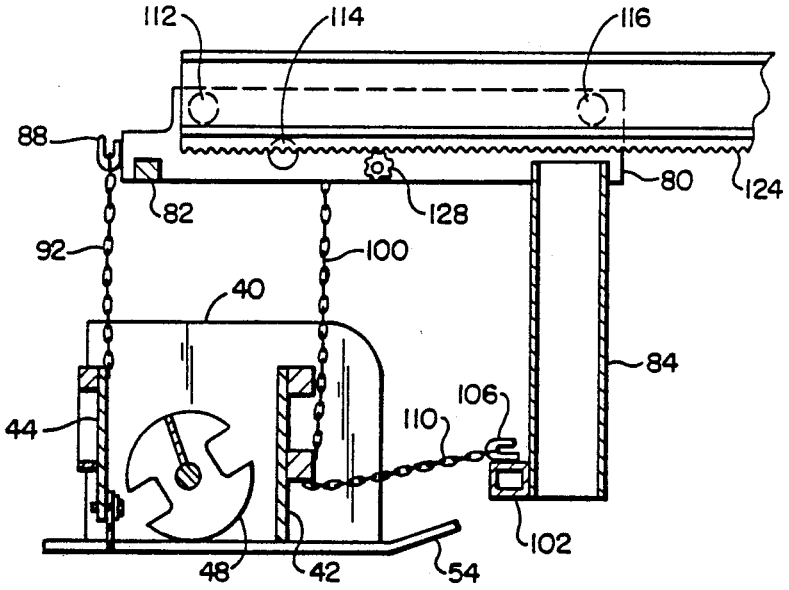
FIG. 4 is a cross-sectional elevational view taken along line 4—4 of FIG. 3.

Referring to FIGS. 2 and 4 in more detail, carriage assembly 66 is seen to be formed from a pair of side members 78 and 80 which are connected by bar 82 and vertical frame 84. Hooks 86 and 88 support rear wall 44 of sealant box 30 by chains 90 and 92 while hooks 94 and 96 support front wall 42 of sealant box 30 by chains 98 and 100. Vertical frame 84 includes frame member 102 that retains hooks 104 and 106 which enable carriage assembly 66 to pull sealant box 30 using chains 108 and 110. Carriage assembly 66 has six roller assemblies identified at 112–122, four of which ride on the upper surface of the lower flange of center boom section 62 and boom extension section 64 and two of which ride along the lower surface of such flanges. Rack 124 is seen extending down from center boom section 62 while rack 126 extends down from boom extension section 64. Pinion gear 128 rides along racks 124 and 126 and is powered by motor 130 which drives carriage assembly 66 along boom sections 62 and 64 for sealant box 30 to dispense fluent material 46 along roadway 20 for filling crack 24. As noted above, the controls for operating motor 130 are not shown in the drawings, but are to be provided in conventional fashion.

Chute 30 is seen extending from the rear of vehicle 12 to just above the top opening in sealant box 30. Chute 34 is connected to filler tank 14 by means not shown in the drawings but which are well known in the art. Chute 34 is seen covered and preferably contains an auger (not shown in the drawings) driven by motor 132 which is connected via drive chain 134 to the auger for providing movement of fluent material 46 from filler tank 14 to be received by sealant box 30.

Mounting assembly 36 is connected to the rear of vehicle 12 by a pair of rearwarly-projecting telescoping arms 136 and 140, and to cross-member 137 which in turn is connected to center boom section 62 by plates 139 and 141. Telescoping arms 136 and 140 are connected, respectively, to rod and piston assemblies 142 and 144, which again are hydraulically powered by hydraulic lines and controls not shown in the drawings. Activation of rod and piston assemblies 142 and 144 enable sealant box 30 to be spaced apart from the rear of vehicle 12 a desirable distance, depending upon where vehicle 12 is parked relative to crack 24. In this regard, it will be appreciated that the driver of vehicle 12 need not park a precise distance from crack 24, but has a fair amount of latitude to just be "close" to crack 24 with the final adjustment being easily accomplished by rod and piston assemblies 142 and 144. Further in this regard, assemblies 142 and 144 need not be activated to the same extent which permits boom sections 62 and 64 to be rotated or canted relative to the rear of vehicle 12, should crack 24 not run precisely transverse to vehicle 12 or should crack 24 not follow a straight line. Again, the driver of vehicle 12 need not park in too limited of a position for operation of inventive sealant box assembly 10, but need only park within a range of positions with the final location of sealant box 30 with respect to crack 24 being readily accomplished via assemblies 142 and 144. Telescoping arms 136 and 140 are raised and lowered with rod and piston assemblies 146 and 148 (see FIGS. 1 and 2). Operation of assemblies 146 and 148 raises and lowers the entire assembly for placing sealant box 30 in an initial operable position as shown in the drawings and for raising sealant box 30 from the surface of roadway 20. Vehicle 12 then can be driven to other cracks or driven to and from remote locations where cracks are to be filled.

Since certain changes may be made in the above-described invention without departing from the scope of the present invention, it is intended that all matter contained in the description thereof or shown in the accompanying drawings shall be interpreted as illustrative and not in a limiting sense.

We claim:

1. A sealant box assembly connectable to a vehicle and adapted to fill transverse roadway cracks, said roadway having a center line, which comprises:

a sealant box adapted to receive and dispense fluent material onto a roadway;

a boom assembly which carries said sealant box and has a drive for moving said sealant box along the length of said boom assembly, transversely of said roadway, one end of said boom assembly positioned for said sealant box to be located at the center line of said roadway while said vehicle is spaced apart therefrom;

a chute extending from said vehicle to said sealant box for filling said sealant box with fluent material; and a mounting assembly connectable to the vehicle and pivotally connected to the boom assembly for its vertical movement.

2. The sealant box assembly of claim 1 wherein said boom assembly includes a center boom section positioned behind said vehicle and which is attached to a boom extension.

3. The sealant box assembly of claim 2 wherein said boom assembly includes a carriage assembly which is connected to said sealant box.

4. The sealant box assembly of claim 3 wherein said sealant box is connected to said carriage assembly by chains.

5. The sealant box assembly of claim 3 wherein said boom assembly includes a drive for moving said carriage assembly along the length of said boom sections.

6. The sealant box assembly of claim 5 wherein said boom sections retain a rack which is engaged by a pinion gear which is attached to a motor for moving said carriage assembly.

7. The sealant box assembly of claim 1 wherein said chute has an auger.

8. The sealant box assembly of claim 1 wherein said sealant box has an auger.

9. The sealant box assembly of claim 1 wherein said mounting assembly includes a rod and piston assembly attached to said boom assembly for its vertical movement.

10. The sealant box assembly of claim 9 wherein said mounting assembly includes a pair of powered telescoping arms operable independently for rotating said boom assembly with respect to said vehicle.

11. The sealant box assembly of claim 10 wherein said pair of telescoping arms each are connected to a rod and piston assembly.

12. A method for filling transverse roadway cracks in a roadway having a center line which comprises:

filling with fluent material a sealant box which is adapted to receive and dispense fluent material onto a roadway, said sealant box being carried by a boom assembly which has a drive for moving the sealant box along the length of said boom assembly, transversely of said roadway;

positioning said sealant box at one end of a crack to be filled;

activating said boom assembly drive for moving said sealant box along the length of said boom assembly for said sealant box to dispense the fluent material onto the roadway to fill the transverse crack; and disengaging said drive and lifting the boom assembly and sealant box from the roadway.

13. The method of claim 12 wherein said boom assembly includes a center boom section positioned behind said vehicle and which is attached to a boom extension.

14. The method of claim 13 wherein said boom assembly includes a carriage assembly which is connected to said sealant box.

15. The method of claim 14 wherein said sealant box is connected to said carriage assembly by chains.

16. The method of claim 14 wherein said boom sections retain a rack which is engaged by a pinion gear which is attached to a motor for moving said carriage assembly.

17. The method of claim 12 wherein an auger in said chute is engaged to fill said sealant box with said fluent material.

18. The sealant box assembly of claim 12 wherein an auger in said sealant box is engaged while said boom drive is activated.

19. The method of claim 12 wherein said mounting assembly includes a rod and piston assembly attached to said boom assembly for lifting said boom assembly and sealant box from the roadway.

20. The method of claim 12 wherein said mounting assembly includes a pair of powered telescoping arms operable independently for rotating said boom assembly with respect to said vehicle.

21. The method of claim 12 wherein said pair of telescoping arms are connected to each to a rod and piston assembly.

22. The method of claim 12 wherein said sealant box is positioned at the center line of the roadway and at one end of the crack with said boom assembly while said vehicle is spaced-apart from said center line.

* * * * *